US010750288B2

(12) United States Patent
Chen et al.

(10) Patent No.: US 10,750,288 B2
(45) Date of Patent: Aug. 18, 2020

(54) SPEAKER WITH HIDDEN FOLDING RING

(71) Applicant: Tymphany Acoustic Technology (Huizhou) Co., Ltd., Huizhou, Guangdong Province (CN)

(72) Inventors: Zhi Chen, Huizhou (CN); Shao Lin Yang, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/403,895

(22) Filed: May 6, 2019

(65) Prior Publication Data

US 2019/0342667 A1 Nov. 7, 2019

(30) Foreign Application Priority Data

May 7, 2018 (CN) ..... 2018 2 0670994 U

(51) Int. Cl.
*H04R 9/02* (2006.01)
*H04R 9/04* (2006.01)
*H04R 9/06* (2006.01)

(52) U.S. Cl.
CPC ..... *H04R 9/025* (2013.01); *H04R 9/041* (2013.01); *H04R 9/046* (2013.01); *H04R 9/06* (2013.01)

(58) Field of Classification Search
CPC ..... H04R 9/025; H04R 9/041; H04R 9/046; H04R 9/06
See application file for complete search history.

(56) References Cited

U.S. PATENT DOCUMENTS 4,532,383 A * 7/1985 Willy ..... G10K 13/00 181/157
5,714,722 A * 2/1998 Noponen ..... H04R 1/24 181/166
6,219,432 B1 * 4/2001 Fryer ..... H04R 7/20 181/171
6,607,051 B1 * 8/2003 Peng ..... H04R 1/16 181/171
9,674,612 B2 * 6/2017 Wang ..... H04R 7/18
(Continued)

FOREIGN PATENT DOCUMENTS

CN 204810535 * 5/2015 ..... H04R 9/06
CN 204810535 * 11/2015 ..... H04R 9/06
TW 201023660 * 6/2010 ..... H04R 9/02

*Primary Examiner* — Oyesola C Ojo
(74) *Attorney, Agent, or Firm* — Muncy, Geissler, Olds & Lowe, PC

(57) ABSTRACT

A speaker with a hidden folding ring includes a basin frame, a magnetic circuit system mounted on the basin frame, a voice coil disposed in a magnetic gap of the magnetic circuit system and a diaphragm. The diaphragm is of a concave structure, and an outer edge end of the diaphragm is connected to an inner bracket of the basin frame through a folding ring. The folding ring is located below the diaphragm, so that a cavity formed between the folding ring and the basin frame. An inner peripheral end of the diaphragm engaged to the voice coil. The present invention effectively increases the radiation area of the diaphragm, and obtains a higher SPL than the existing speaker of the same size, thereby improving the acoustic performance of the speaker.

14 Claims, 4 Drawing Sheets

(56) References Cited

U.S. PATENT DOCUMENTS

| | | | | |
|---|---|---|---|---|
| 2002/0148678 | A1* | 10/2002 | Sahyoun | H04R 7/20 181/172 |
| 2006/0239494 | A1* | 10/2006 | Kimura | H04R 7/127 381/386 |
| 2009/0180648 | A1* | 7/2009 | Endo | H04R 1/24 381/184 |
| 2010/0172537 | A1* | 7/2010 | Campbell | H04R 7/20 381/423 |
| 2017/0111729 | A1* | 4/2017 | Robineau | H04R 1/24 |
| 2018/0035187 | A1* | 2/2018 | Cook | H04R 1/028 |

* cited by examiner

SPEAKER WITH HIDDEN FOLDING RING

TECHNICAL FIELD

The present invention relates to the technical field of speakers, in particular to a speaker with a hidden folding ring.

BACKGROUND

The structure of an ordinary speaker typically comprises a magnetic loop system, a vibration system, and a support auxiliary system that are connected with each other, wherein the magnetic circuit system includes a T-iron and a permanent magnet, the vibration system includes a diaphragm, a folding ring and a voice coil, while the support auxiliary system includes a basin frame, and wherein the basin frame is connected to a speaker cabinet, the magnetic circuit system is mounted on the basin frame, the voice coil is placed in a magnetic gap of the magnetic circuit system, the diaphragm is connected to the basin frame through the folding ring, and the diaphragm is engaged with the voice coil.

In the prior art, the folding ring is used to support the diaphragm to freely vibrate in the axial direction without lateral movement, and also to ensure the axial movement of the voice coil in the magnetic gap. As shown in FIG. 1, currently, the shape of the folding ring 33 is generally convex with one end connected to the diaphragm 31 and the other end connected to the basin frame 1, and the folding ring 33 is located outside the diaphragm 31, so that the effective radiation area of the diaphragm 31 requires to be obtained by subtracting the area covered by the folding ring 33, and the radiation area is proportional to the SPL. Therefore, the SPL of the speaker in the prior art is not high.

Therefore, there is an urgent need to develop a special structure of folding ring to obtain a higher SPL, thereby improving acoustic performance.

SUMMARY

In order to solve the above problems existing in the prior art, the present invention provides a speaker with a hidden folding ring, wherein the folding ring is disposed on an inner side of the diaphragm, which effectively increases the outer diameter of the diaphragm, so that the effective radiation area is increased, thereby improving the SPL of the speaker and obtaining a speaker with ideal acoustic performance.

To achieve the above object, the present invention provides the following technical solutions:

A speaker with a hidden folding ring, comprising a basin frame, a magnetic circuit system mounted on the basin frame, a voice coil disposed in a magnetic gap of the magnetic circuit system and a diaphragm. The diaphragm is of a concave structure, and an outer edge end of the diaphragm is connected to an inner bracket of the basin frame through a folding ring. The folding ring is located below the diaphragm, so that a cavity is formed between the folding ring and the basin frame. An inner peripheral end of the diaphragm is engaged to the voice coil.

Further, a gap is provided between a position where the folding ring is connected on the outer edge end of the diaphragm and an outer edge end of the basin frame.

Further, the gap is less than 1 mm.

Further, the folding ring is concave or corrugated.

Further, the speaker further comprises a centering tab, one end of the centering tab is connected to the voice coil, and the other end of the centering tab is used to connect the inner bracket of the basin frame; the folding ring has a circular arc concave shape, one end of the folding ring is used to connect the diaphragm, and the other end of the folding ring is used to connect the inner bracket of the basin frame. This technical solution is suitable for a speaker with a model size of 3 inches or more.

Further, the folding ring is corrugated, one end of the folding ring is used to connect the diaphragm, and the other end of the folding ring is used to connect the inner bracket of the basin frame. This technical solution is suitable for a speaker with a model size of 3 inches or less and is a design in which there is no centering tab.

Further, the cavity is provided with sound absorbing cotton therein. The function of the sound absorbing cotton is to adjust the influence of the cavity on the SPL curve.

Further, the surface of the diaphragm is provided with a plurality of reinforcing ribs.

Based on the above technical solutions, the technical effects obtained by the present invention are: the present invention discloses a speaker with a hidden folding ring; compared to the speaker in the prior art, the present invention intelligently sets the folding ring on the inner side of the diaphragm instead of the outer side of the diaphragm so as to effectively increase the radiation area of the diaphragm, and obtains a higher SPL than the existing speaker of the same size, thereby improving the acoustic performance of the speaker. Further, in order to ensure the effective vibration of the diaphragm, a gap of less than 1 mm is provided between a position where the folding ring is connected on the outer edge end of the diaphragm and an outer edge end of the basin frame. The present invention may ensure the safe use of the speaker, eliminates the influence from the reflected wave under the folding ring, may maximize the reduction of the height of the speaker, and has a wide application range.

Figure 1:
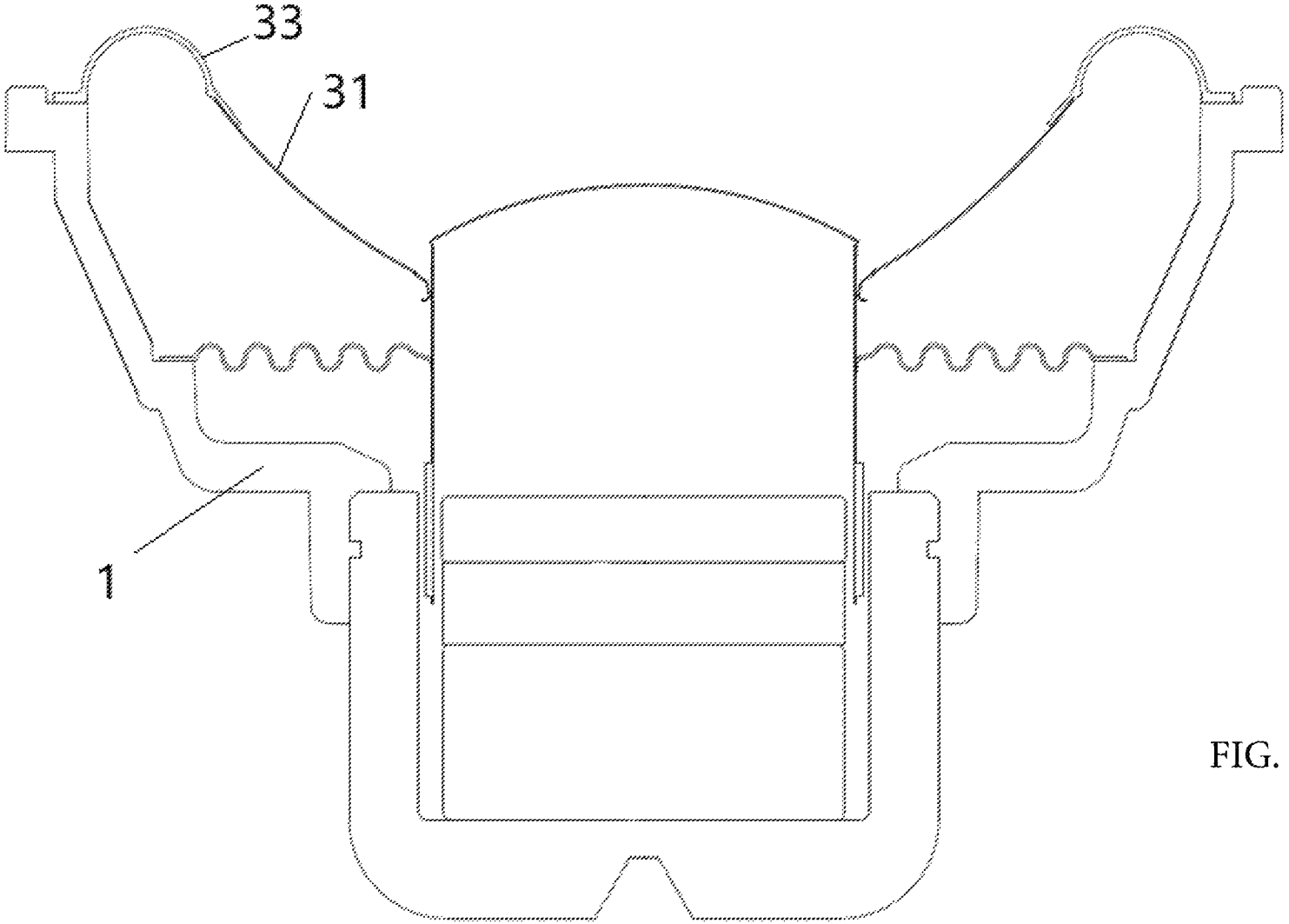
FIG. 1 is a structural view of a conventional speaker in the prior art.

Among those, the reference numerals are as follows:

1: basin frame, 11: inner bracket, 2: magnetic circuit system, 3: vibration system; 31: diaphragm, 32: voice coil, 33: folding ring, 4: centering tab, 5: dust-proof cap, 6: cavity, 7: sound absorbing cotton.

DETAILED DESCRIPTION

In order to facilitate the understanding of the present invention, the present invention will be described more fully hereinafter with reference to the accompanying drawings and specific embodiments. Preferred embodiments of the present invention are shown in the drawings. However, the present invention may be embodied in many different forms and is not limited to the embodiments described herein. Rather, these embodiments are provided so that this disclosure of the present invention will be more fully understood.

It should be noted that when an element is referred to as being "fixed" to another element, it can be directly on the other element or a center element can be present. When an element is referred to as being "connected" to another element, it can be directly connected to the other element or a center element can be present simultaneously.

For ease of reading, the terms "upper", "lower", "left", and "right" are used herein in the drawings to indicate the relative position of the reference between the elements, and not to limit the application.

All technical and scientific terms used herein, unless otherwise defined, have the same meaning as commonly understood by one of ordinary skill in the art to the present invention. The terminology used in the description of the present invention is for the purpose of describing particular embodiments and is not intended to limit the present invention.

Embodiment 1

Figure 2:
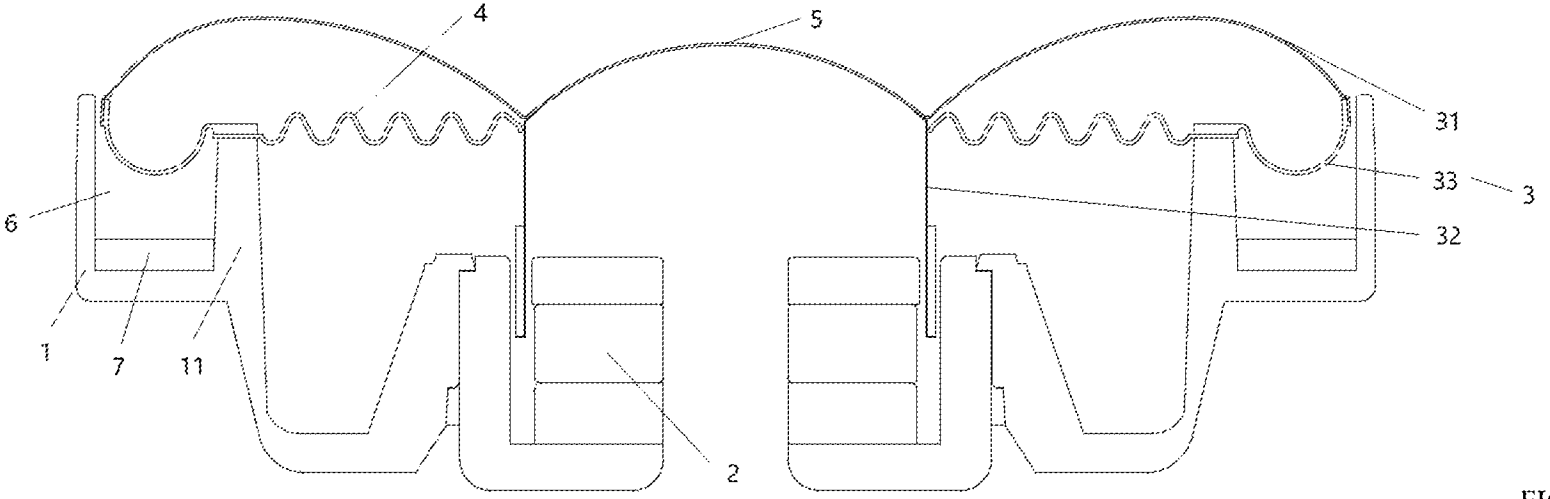
FIG. 2 is a structural view of a speaker in Embodiment 1.

The present embodiment provides a speaker with a hidden folding ring having a size of 3.5 inches. As shown in FIG. 2, the speaker includes a basin frame 1 used as a support, a magnetic circuit system 2, a vibration system 3, a centering tab 4, and a dust-proof cap 5. Among them, the magnetic circuit system 2 is mounted on the basin frame 1 to provide a magnetic field to the vibration system 3, and the magnetic circuit system 2 includes a T-iron and a permanent magnet. And a magnetic shield may be disposed on the periphery of the T-iron and the permanent magnet according to actual needs.

With continued reference to FIG. 2, the vibration system 3 includes a diaphragm 31, a voice coil 32, and a folding ring 33. The voice coil 32 is a driving unit of the speaker, and is generally wound on a paper tube (i.e., a coil) in two layers by using a very thin copper wire. It is placed in a magnetic gap of the magnetic circuit system 2 and is fixed to the diaphragm 31. When a current carrying acoustic information and moment changes passes into the voice coil 32, a magnetic field is generated in different directions in one instant and the next instant, and then the voice coil 32 thus vibrates back and forth according to the change of the magnetic force, thereby driving the diaphragm to vibrate back and forth, so that the speaker emits sound. The diaphragm 31 of the present embodiment is in an integrated concave design, and the surface of the diaphragm 31 is provided with a plurality of reinforcing ribs; an outer edge end of the diaphragm 31 is connected to the inner bracket 11 of the basin frame 1 via a folding ring 33, and the inner peripheral end of the diaphragm 31 is engaged to the voice coil 32. The folding ring 33 has a circular arc concave shape, one end of the folding ring 33 is used to connect the diaphragm 31, and the other end of the folding ring is used to connect the inner bracket 11 of the basin frame 1, so that the folding ring 33 is located below the diaphragm 31, thereby effectively increasing the radiation area of the diaphragm 31. Such a design forms a cavity 6 between the folding ring 33 and the basin frame 1. In order to prevent the cavity 6 from affecting the SPL, sound absorbing cotton 7 may be disposed in the cavity. Further, in order to ensure the effective vibration of the diaphragm 31, a gap of less than 1 mm is provided between a position where the folding ring 33 is connected on the outer edge end of the diaphragm 31 and an outer edge end of the basin frame 1.

Figure 3:
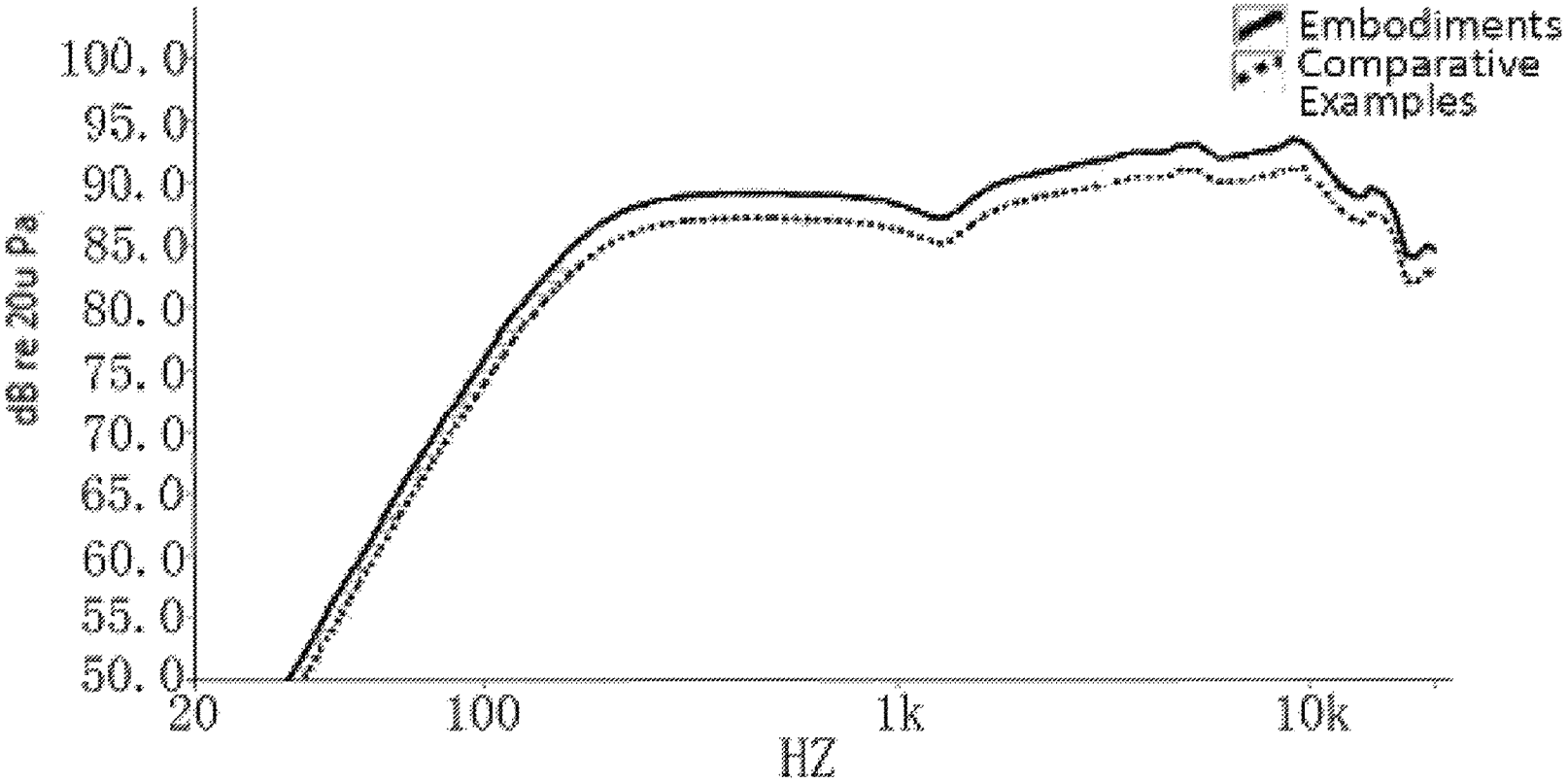
FIG. 3 is a SPL curve of a speaker in Embodiment 1 vs. a conventional speaker of the same size in the prior art.
Figure 4:
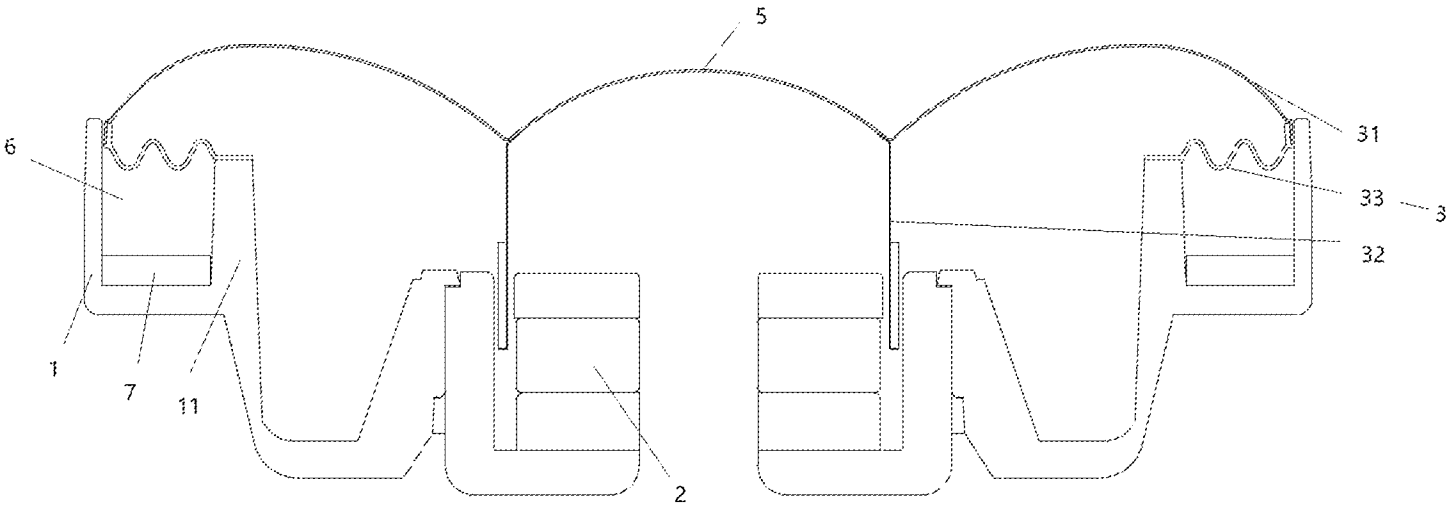
FIG. 4 is a structural view of a speaker in Embodiment 2.

In the present embodiment, since the folding ring 33 is disposed on the inner side of the diaphragm 31, i.e. being designed as a hidden folding ring, the influence of the reflected wave under the folding ring is eliminated, so that the radiation area of the diaphragm 31 is greatly increased, the efficiency is improved, and a higher SPL is obtained. As shown in FIG. 3, compared with the speaker of the same size in the prior art (the structural composition is as shown in FIG. 1), the SPL of the speaker of the present embodiment is 2 dB higher than the average so as to provide a good acoustic performance.

The speaker of the present embodiment further comprises a centering tab 4. The centering tab 4 is of a concentric annular structure, and functions to support the joint portion of the voice coil 32 and the diaphragm 31 to ensure that it is vertical without skew. The centering tab 4 is provided with a plurality of concentric rings, so that the voice coil 32 is free to move up and down in the magnetic gap without lateral movement. In the present embodiment, one end of the centering tab 4 is connected to the voice coil 32, the other end thereof is used to connect the inner bracket 11 of the basin frame 1, and the corresponding inner bracket 11 is connected with the folding ring 33. The dust-proof cap 5 is disposed on the centering tab 4 for preventing the voice coil 32 from rubbing with the foreign matter to emit an abnormal sound due to external dust or the like falling into the magnetic gap.

It should be noted that the material used in the diaphragm 31 of the present embodiment is required to be light in weight and good in rigidity, and does not change due to changes in ambient temperature and humidity, including natural fiber or man-made fiber or resin or rubber or metal film, wherein natural fibers may be selected from cotton, wood, wool, silk, etc., and man-made fibers may be selected from rayon, nylon, fiberglass, etc. The folding ring 33 may be made of the same material as the diaphragm, and the folding ring 33 may be integrally formed with the diaphragm 31 or may be bonded to the diaphragm 31 by heat pressing.

Embodiment 2

The present embodiment provides a speaker with a hidden folding ring. The speaker is in a non-elastic wave design and is less than 3 inches in size. The difference from the structure of the speaker of Embodiment 1 is that the speaker of the present embodiment is not provided with a centering tab structure (i.e., has no elastic wave), and the folding ring has a corrugated shape, but is not limited to a corrugated shape, as long as it may be vertically moved up and down.

As shown in FIG. 3, the speaker of the present embodiment comprises a basin frame 1 used as a support, a magnetic circuit system 2, a vibration system 3, and a dust-proof cap 5, and the magnetic circuit system 2 is mounted on the basin frame 1. The vibration system 3 includes a diaphragm 31, a voice coil 32, and a folding ring 33; the voice coil 32 is placed in a magnetic gap of the magnetic circuit system 2, and is fixed integrally with the diaphragm 31; the voice coil 32 is covered with the dust-proof cap 5. The diaphragm 31 of the present embodiment is in an integrated concave design, and the surface of the diaphragm 31 is provided with a plurality of reinforcing ribs; an outer edge end of the diaphragm 31 is connected to the inner bracket 11 of the basin frame 1 via a folding ring 33, and the inner peripheral end of the diaphragm 31 is engaged to the voice coil 32. One end of the folding ring 33 is used to connect the diaphragm 31, and the other end of the folding ring is used to connect the inner bracket 11 of the basin frame 1. Such a design forms a cavity 6 between the folding ring 33 and the basin frame 1. In order to prevent the cavity 6 from affecting the SPL, sound absorbing cotton 7 may be disposed in the cavity 6. Further, in order to ensure the effective vibration of the diaphragm 31, a gap of less than 1 mm is provided between a position where the folding ring 33 is connected on the outer edge end of the diaphragm 31 and an outer edge end of the basin frame 1.

For the speaker of Embodiments 1 and 2, since the folding ring 33 is skillfully designed on the inner side of the diaphragm 31, the influence of the reflected wave under the folding ring 33 is eliminated, and the outer diameter of the diaphragm 31 is effectively increased, thereby expanding the radiation area of the diaphragm 31. Therefore, compared with the speaker of the same size, a higher SPL may be obtained and a better acoustic performance may be acquired.

The above is only an example and description of the structure of the present invention, and the description thereof is more specific and detailed, but is not to be construed as limiting the scope of the present invention. It should be noted that a number of variations and modifications may be made by those skilled in the art without departing from the spirit and scope of the present invention. These obvious alternatives are within the scope of protection of the present invention.

The invention claimed is:

1. A speaker with a hidden folding ring, comprising:

a basin frame;

a magnetic circuit system mounted on the basin frame;

a voice coil disposed in a magnetic gap of the magnetic circuit system; and a diaphragm, wherein the diaphragm is of a concave structure, and an outer edge end of the diaphragm is connected to an inner bracket of the basin frame through a folding ring, and wherein the folding ring is located below the diaphragm and extended inwardly from the outer edge end of the diaphragm to connect with the inner bracket, so that a cavity is formed between the folding ring and the basin frame; an inner peripheral end of the diaphragm is engaged to the voice coil.

2. The speaker with a hidden folding ring according to claim 1, wherein a gap is provided between a position where the folding ring is extended inwardly from the outer edge end of the diaphragm toward the inner bracket of the basin frame.

3. The speaker with a hidden folding ring according to claim 2, wherein the gap is less than 1 mm.

4. The speaker with a hidden folding ring according to claim 1, wherein the folding ring is concave or corrugated.

5. The speaker with a hidden folding ring according to claim 4, further comprising a centering tab, one end of the centering tab is connected to the voice coil, and the other end of the centering tab is used to connect the inner bracket of the basin frame; the folding ring has a circular arc concave shape, one end of the folding ring is used to connect the diaphragm, and the other end of the folding ring is used to connect the inner bracket of the basin frame without connecting to an outer edge end of the basin frame.

6. The speaker with a hidden folding ring according to claim 1, wherein the folding ring is corrugated, one end of the folding ring is used to connect the diaphragm, and the other end of the folding ring is used to connect the inner bracket of the basin frame without connecting to an outer edge end of the basin frame.

7. The speaker with a hidden folding ring according to claim 1, wherein the cavity is provided with sound absorbing cotton therein.

8. The speaker with a hidden folding ring according to claim 1, wherein the surface of the diaphragm is provided with a plurality of reinforcing ribs.

9. The speaker with a hidden folding ring according to claim 2, wherein the surface of the diaphragm is provided with a plurality of reinforcing ribs.

10. The speaker with a hidden folding ring according to claim 3, wherein the surface of the diaphragm is provided with a plurality of reinforcing ribs.

11. The speaker with a hidden folding ring according to claim 4, wherein the surface of the diaphragm is provided with a plurality of reinforcing ribs.

12. The speaker with a hidden folding ring according to claim 5, wherein the surface of the diaphragm is provided with a plurality of reinforcing ribs.

13. The speaker with a hidden folding ring according to claim 6, wherein the surface of the diaphragm is provided with a plurality of reinforcing ribs.

14. The speaker with a hidden folding ring according to claim 7, wherein the surface of the diaphragm is provided with a plurality of reinforcing ribs.

* * * * *